US007820091B1

(12) United States Patent
Weiner

(10) Patent No.: US 7,820,091 B1
(45) Date of Patent: Oct. 26, 2010

(54) EMBEDDED VINYL PRODUCTS AND METHOD OF PRODUCING SAME

(75) Inventor: Robert S. Weiner, Atlanta, GA (US)

(73) Assignee: Product Concepts Residential, LLC, Dalton, GA (US)

( * ) Notice: Subject to any disclaimer, the term of this patent is extended or adjusted under 35 U.S.C. 154(b) by 1709 days.

(21) Appl. No.: 10/606,074

(22) Filed: Jun. 25, 2003

(51) Int. Cl.
*B32B 5/02* (2006.01)
*B32B 27/00* (2006.01)

(52) U.S. Cl. ..... 264/172.19; 264/74

(58) Field of Classification Search ..... 264/266, 264/271.1, 279.1, 299, 319, 324, 73, 74, 264/76, 172.19, 173.1
See application file for complete search history.

(56) References Cited

U.S. PATENT DOCUMENTS 1,730,673 A * 10/1929 Mell ..... 264/76
2,867,263 A * 1/1959 Bartlett ..... 156/231
3,264,385 A * 8/1966 Reed ..... 264/104
3,350,483 A * 10/1967 Erb et al. ..... 264/74
3,360,414 A * 12/1967 Tuthill ..... 156/264
3,383,442 A * 5/1968 Mountain ..... 264/74
3,923,941 A * 12/1975 Weaver ..... 264/73
4,349,597 A * 9/1982 Fine et al. ..... 428/95
5,015,516 A * 5/1991 Lussi et al. ..... 428/143
5,645,889 A * 7/1997 Potosky et al. ..... 427/256
5,695,696 A * 12/1997 Hensler et al. ..... 264/21
6,589,631 B1 * 7/2003 Suzuki et al. ..... 428/172
6,696,004 B1 * 2/2004 Weiner et al. ..... 264/257
6,903,033 B1 * 6/2005 Weiner et al. ..... 442/16
2003/0072919 A1 * 4/2003 Watts, Jr. et al. ..... 428/159

* cited by examiner

*Primary Examiner*—Matthew J. Daniels
(74) *Attorney, Agent, or Firm*—Stephen J. Stark; Miller & Martin PLLC

(57) ABSTRACT

A method for providing embedded vinyl products comprises applying design material to a bottom or a top surface of a liquid vinyl substrate. When applying to the bottom surface liquid vinyl substrate, the design materials are applied to a conveyor and the vinyl substrate layer is applied over the design material. When applying to an exposed top layer of the vinyl substrate, the design material is applied so that at least a portion of it remains visible from the top surface of the exposed layers so that it creates a design therein.

12 Claims, 3 Drawing Sheets

EMBEDDED VINYL PRODUCTS AND METHOD OF PRODUCING SAME

BACKGROUND OF THE INVENTION

1. Field of the Invention

This invention relates to vinyl products, more specifically to vinyl products having embedded particles therein.

2. Brief Description of Related Art

Tufted pile carpet, when provided as tile normally has at least one layer of vinyl below the yarn pile. These layers are not visible from above since the yarn extends from a backing above the vinyl layer and obscures view to the vinyl layer(s) below. The vinyl layers improve the cushioning effect of the carpet as well as the durability of the carpet.

Some manufacturers imprint arrow signs on the reverse, or bottom side, of the vinyl layer to aid an installer during the installation of carpet tile. These imprints are not covered with additional layers of vinyl since they need to be visible during installation, if at all, depending upon the skill of the installer. Furthermore, the images are not visible once the tile is installed since the image is obscured by the vinyl layer(s), backing and pile.

Linoleum is typically manufactured by placing at least one pattern layer atop a backing and then covering with a clear wear layer. The pattern layers are believed to have the pattern preformed therein prior to the pattern layer being applied to the backing. While linoleum has been provided in tile and roll formats, a need exists for an alternative flooring product which has advantages including high durability and attractive aesthetic properties.

U.S. Pat. No. 5,781,941 shows a bath mat having a non-vinyl base layer with a design printed thereon and subsequently coated with a vinyl layer with polycarbonate particles sprayed onto the vinyl so that the polycarbonate particles are absorbed into the vinyl layer as shown in FIGS. 2 and 3. The polycarbonate particles do not extend to the upper surface of the vinyl layer as they are shown completely coated by the vinyl.

U.S. Pat. No. 4,625,344 shows a similar construction where sand particles are coated during the application process of the particles through spraying similar to U.S. Pat. No. 5,781,941. While these techniques described and shown in these patents may provide a non-slip surface, the textures left by this process are not believed to be desirable for some applications and do not fully exploit the design potential of embedded particles in vinyl.

SUMMARY OF THE INVENTION

An object of the invention is to provide a new vinyl product and method of its manufacture for use with flooring, wall covering and possibly other uses.

It is another object of the present invention to provide an aesthetically pleasing and durable sheet vinyl product.

It is another object of the present invention to provide a method and vinyl product for which provides desirable visual effects.

Accordingly, a vinyl product and its method of manufacture are disclosed herein. Vinyl, more precisely, polyvinyl chloride, is available in liquid form which can be manufactured into solid sheets having one or more layers. A decorative image is formed on a top or bottom surface of the vinyl layer. The decorative image may be formed by the application of material to an exposed, or top layer, of the vinyl prior to curing, or alternatively the decorative image may be provided on the surface of the vinyl carried by a conveyor belt through the curing process (i.e., the bottom surface). When applying to the exposed surface, the particulate may be dropped, sprayed or otherwise applied without completely coating the embedded particles as has been done in the prior art. When the design is to be provided on the surface carried by the belt through the manufacturing process, the design material may be first placed on the belt prior to applying the liquid vinyl substrate to the conveyor belt. Accordingly, the design material along with the vinyl form a surface which conforms to the surface of the belt. When the designs are applied to the belt prior to applying the vinyl substrate, interesting designs can be created when the design material is provided in liquid form especially when the design material is only allowed to partially cure, if at all, prior to applying the vinyl liquid substrate.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
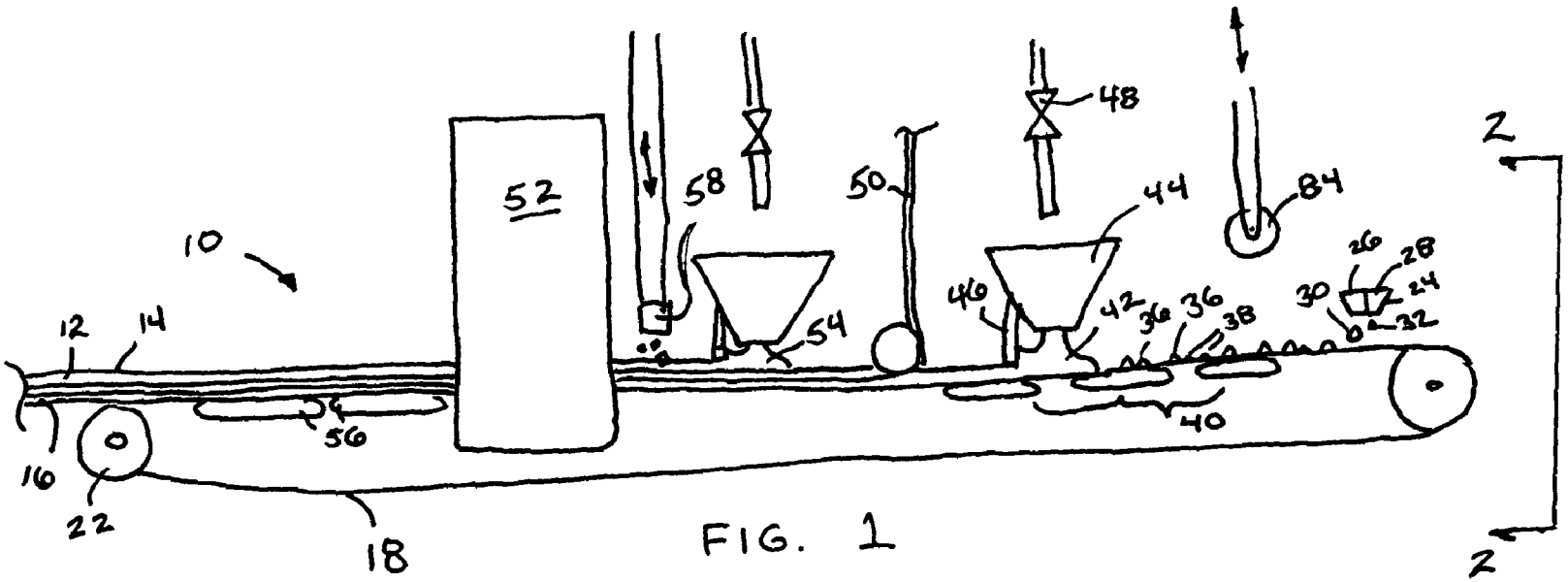
FIG. 1 is a schematic view showing the method of making the vinyl product.

Accordingly, FIG. 1 shows the production line 10 for producing vinyl product 12. The vinyl product 12 has an upper side 14 or an exposed side as well as a bottom surface 16 which is supported on a conveyor illustrated as a belt 18 through the manufacturing process in the preferred embodiment. The belt 18 is supported by rollers 20,22, and other rollers and supports may also be utilized through the manufacturing processes as needed. Beginning at first roller 20, the belt 18 may be applied with a design material such as liquid vinyl from hopper 24.

Figure 3:
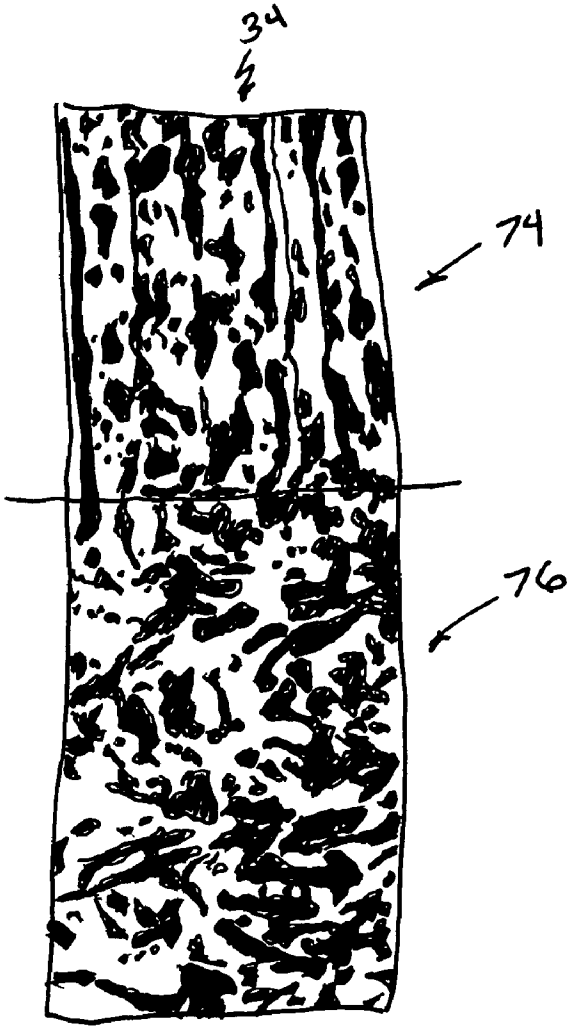
FIG. 3 is a top view of the belt in a first preferred embodiment after the application of the particulate to the belt and prior to the application of the liquid vinyl substrate.

In the preferred embodiment as illustrated in FIG. 1, the hopper 24 is divided into first and second compartments 26,28 which allow for the deposition of two different design material onto the belt 18. Specifically, in a presently preferred embodiment the hopper 24 dispenses two different colors of liquid vinyl illustrated as droplets 30,32 respectively from the first and second compartments 26,28. Each of the droplets 30,32 may take other forms as they leave the hopper 24, but droplets are illustrated for the convenience of illustration purposes. When the droplets 30,32, contact the belt 18, they form a pattern 34 as shown in FIG. 3. FIG. 3 will be discussed in further detail below. Alternatively, the hopper may contain vinyl having two different viscosities as hereinafter described.

The design material may vary in nature from one provided in liquid vinyl or other liquid form having various viscosity properties, various melting points in addition to color selections. Accordingly, a first deposited material 36 may respond differently upon contact with the belt 18 than the second deposited material 38 such as by forming a tighter droplet, i.e., not spreading out as much for the same volume of the viscosities differ. Of course, the hopper 24 may be designed such that orifices or jets may be of various sizes to also effect the pattern 34 created on the belt 18. Solid design material may also be dispensed from one or more compartments 26,28 in the hopper 24 or hoppers.

It has been found desirable to partially cure the deposited material, especially when liquid is applied so that when applying the substrate vinyl layer, the colors do not run together. (The substrate layer is typically selected as a different color from the design material.) Although in some environments, it may be desirable to have some running of colors. Accordingly, heated plates 40 are useful to at least partially cure the design material prior to the application of substrate layer 42 from dispenser 44 as shown in FIG. 1 in the preferred embodiment. In other embodiments, this step may not be necessary or desired. A leveler 46 is useful to provide a desired thickness between the top and bottom surfaces 14,16 of the vinyl product 12. The dispenser 44 may be supplied from a plurality of sources and valves 48 allow for selective control from liquid vinyl supply sources not shown in FIG. 1. When applying the substrate layer 42 over the first and/or second deposited materials 36,38, if so utilized, the vinyl product 12 then may pass through oven 52 and over chilling plates 52 to provide the vinyl product 12 shown passing over second roller 22 for further processing such as cutting into tiles or rolling into rolls, etc.

While liquid vinyl has been the design material discussed, other deposited material such as chips, pellets, polyethylene pellets, or other form of polyethylene, polypropylene, and/or metal in various forms and colors may be utilized as design material. Furthermore, multiple colors may be utilized along with various design material types.

After applying the substrate layer 42 over the design material, a fiberglass scrim 50 or other material may be placed on the substrate layer 54 and a second vinyl layer 54 applied as shown in FIG. 1. The fiberglass scrim 50 is believed to add stability to the flooring product, but is not necessary in all embodiments. As can be seen in FIG. 1, the scrim 50 is placed atop the substrate layer 42 and fed towards oven 52.

With the second vinyl substrate layer 54 applied to the scrim 50 over the first layer 42, the "sandwich" is sent to the oven 52 where it is cured and onto cooling plates 56 where the vinyl product 12 is then directed for further processing.

While in the preferred embodiment the design material is placed directly on top of the conveyor illustrated as belt 18, it is alternatively preferred that the design material may be placed on the upper surface 14 of the vinyl product 12 as shown in FIG. 1. An applicator 58 may move up and down as illustrated to shake the pellets, like a salt shaker onto the upper surface 14. In addition to the up and down movement, the applicator 58 may also move side to side or otherwise to impart a particular design on top of the upper layer 14. Of course, it is alternatively preferred that only a single layer of vinyl substrate 52 or 54 be utilized with this process.

Figure 4:
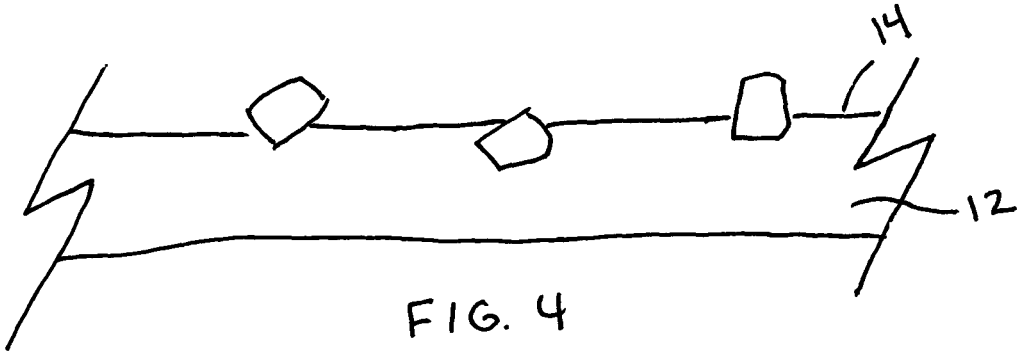
FIG. 4 is a second preferred embodiment showing particulate matter extending from the top surface of the cured vinyl.

When utilizing the applicator 58 it is anticipated that the design material will be deposited to remain at least level with top surface 14 of the vinyl product 12, if not extending a distance above the upper level 14 as shown in FIG. 4. If the design material is liquid, it is possible that it may be substantially planer with the upper level 14 depending on the viscosity. Alternatively, the design material may rise in bumps or in discontinuous particulate form as shown in FIG. 4. Accordingly, by depending on the selection of the design material, various configurations and textures may be developed. It is important that the design material not be encapsulated within the vinyl material during the application process as this has been done before, and although it would impart texture to the vinyl product, it does not impart a design since the vinyl substrate layer 54 would be continuous across this upper surface. Since the design material is preferably at least one different color than the substrate layer 54, obscuring it within the substrate layer 54 would cause the intended design to "disappear."

Figure 2:
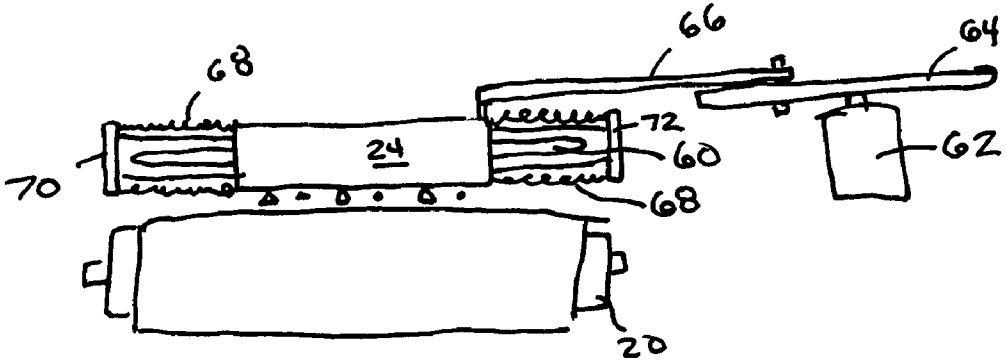
FIG. 2 is a cross section taken along the line 2-2 of FIG. 1.

FIG. 2 shows a front view of the first roller 20 as taken along the line 2-2 in FIG. 1. The hopper 24 is shown supported on a track 60 and driven by motor 62 so that the hopper 24 moves laterally about the track 60 in a desired reciprocating motion. Gear 64 is connected to the motor 62 which drives link 66 connected to the hopper 24. Spring members 68 between stops 70,72 have been found useful to assist in imparting the desired motion to the hopper 24.

FIG. 3 is useful to show the difference between a stationery hopper 24 and a reciprocating hopper 24 as moved as described above. First design 74 was made with a stationery hopper constructed in accordance with the preferred embodiment. The hopper 24 is constructed as a pan having a plurality of orifices at the bottom which are various diameters such that when liquid vinyl is placed therein, it drips and/or streams depending upon the viscosity of the liquid and the speed of the conveyor to create the first design 74. Furthermore, while orifices are described as being located in the hopper 24, this orifices may take a variety of shapes. Of course, the speed of the belt 18 also plays a role in the particular first design 74 experienced on the belt 18. Using the same viscosity, hopper configuration and speed of the belt 18 while imparting a lateral reciprocating motion to the 24 results in second design 76 which is believed to be more desirable in some applications. Although a single color is illustrated in FIG. 3 for simplicity's sake, a plurality of colors could be dispensed from various configurations of hoppers 24 to create even more unusual patterns 34. Furthermore, in addition to applying liquid design material, particulate could also be deposited to form the patterns 34. Once the liquid is deposited on the conveyor, the liquid may be partially cured or not cured at all or completely cured prior to applying a substrate layer shown in FIG. 1.

Figure 5:
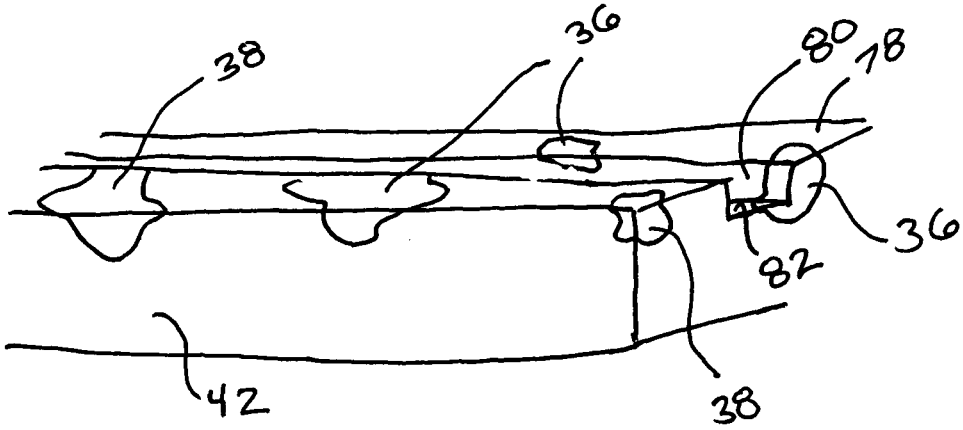
FIG. 5 is a top perspective sectional view of a portion of the vinyl tile produced in accordance of the method of FIG. 1 in the preferred embodiment.

As shown in FIG. 5, an interesting feature about applying a liquid design material to the conveyor is that it conforms to the texture of the belt surface 18. Accordingly, FIG. 5 shows a single layer substrate 42 with first and second deposition material 36,38 which extend up to the top surface 78 as well as side surfaces 80 and channel surface 82 which correspond with a groove or a ridge on the belt 18. Of course, other belts 18 may have other patterns such as a checkerboard pattern, or even embossed designs which can be imprinted on the vinyl product top surface (It is to be understood that the top surface 78 in this embodiment was originally the lower surface 16 as it passed through the production line 10). Just like in the alternatively preferred embodiment shown in FIG. 4, the design material extends up to the top surface 78, side surface and channel surface 82 and the design material is not encapsulated as has been done in the prior art.

Additionally, although the pellets illustrated as cylindrically or barrel shaped in FIG. 4, they could take on a variety of shapes depending on the desire of the designer. Initially, it may be desirable to not partially cure the design material when it is in liquid form so that it might intentionally diffuse into the substrate layers 54 or 42. Accordingly, the design material may have different sizes, different shapes, different colors, different material, varying viscosity, varying melting points, and be applied through a moving applicator or a stationery applicator including applicators that move laterally oscillate up and down. Furthermore, a roller 84 having a design impressed thereon as shown in FIG. 4 may be lowered as illustrated to contact the first and second deposited material 36,38 and provide a pattern which corresponds at least partially to that on the roller 84 prior to applying the substrate 42. Liquid vinyl design material utilized includes high melt, low melt, scratch resistant, not scratch resistant and various thickeners and solvents have been added to create various textures and designs.

When adding solids of design material, the color can vary from being opaque, translucent, transparent, to any desired color. The particulate may be added as cylinders, irregular chips, or any other shape desired. Additionally, when added as a particulate, it may have a melting point so that it can possibly partially diffuse into the surrounding vinyl substrate. Accordingly, the designs can vary to a design somewhat akin to a Jackson Pollock to repetitive patterns to intended images especially when a roller 82 is utilized. Accordingly, a wide range of patterns and designs can be created utilizing the techniques described and shown herein. After producing the embodiments in FIG. 4 and FIG. 5, a clear or translucent layer of vinyl may be applied.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of creating a vinyl sheet product comprising the steps of:

depositing a design material onto a conveyor, said design material in the form of one of drips, streams, chips and pellets deposited so as to not completely cover a top surface of the conveyor where applied;

applying a first vinyl substrate layer of a predetermined height over on the conveyor over the design to create a vinyl sheet product, at least a portion of the design material remaining in contact with the conveyor; and curing the vinyl sheet product, wherein when the vinyl sheet product is removed from the conveyor, the design material forming an indicia relative to the first vinyl substrate layer and inverted for use in installations with which is visible from above when installed.

2. The method of claim 1 further comprising the step of applying a scrim to an exposed surface of the first vinyl substrate layer after applying the first vinyl substrate layer.

3. The method of claim 2 further comprising the step of applying a second vinyl substrate layer over the scrim.

4. The method of claim 1 wherein the step of depositing the design material further comprises depositing a liquid design material directly onto the conveyor.

5. The method of claim 4 further comprising the step of at least partially curing the liquid design material prior to applying the first vinyl substrate layer.

6. The method of claim 4 further comprising the step of applying at least two distinct colors of liquid design material.

7. The method of claim 4 wherein the step of depositing the liquid design material further comprises providing a hopper having a plurality of orifices configured to apply the liquid design material from the hopper through the orifices to the conveyor.

8. The method of claim 7 wherein the hopper is moved while depositing the liquid design material to the conveyor.

9. The method of claim 7 wherein the hopper is moved in an laterally reciprocating motion while depositing the material to the conveyor.

10. The method of claim 4 further comprising the step of applying a roller having an embossed indicia thereon to the liquid design material prior to applying the first vinyl substrate layer.

11. The method of claim 1 wherein the step of curing the vinyl product further comprises transporting the product through an oven, and further comprising the step of cooling the cured vinyl after the product has left the oven.

12. The method of claim 1 further comprising the step of providing a conveyor having at least two different heights thereby imparting a texture to a lower surface of the vinyl sheet product.

* * * * *